US006365812B1

(12) United States Patent
McGill

(10) Patent No.: US 6,365,812 B1
(45) Date of Patent: Apr. 2, 2002

(54) DRUMHEAD MATERIAL AND METHOD

(75) Inventor: David McGill, Barrington, RI (US)

(73) Assignee: Dimension Polyant Sailcloth, Inc., Putnam, CT (US)

( * ) Notice: Subject to any disclaimer, the term of this patent is extended or adjusted under 35 U.S.C. 154(b) by 0 days.

(21) Appl. No.: 09/488,477

(22) Filed: Jan. 20, 2000

(51) Int. Cl.[7] ..... G10D 13/02
(52) U.S. Cl. ..... 84/414; 84/413; 84/418
(58) Field of Search ..... 84/414, 413, 418, 84/411 R

(56) References Cited

U.S. PATENT DOCUMENTS

| | | | | |
|---|---|---|---|---|
| 729,936 A | | 6/1903 | Heybeck | |
| 1,018,767 A | | 2/1912 | Logan | |
| 1,809,050 A | | 6/1931 | Logan | |
| 2,667,098 A | | 1/1954 | McMullen | 84/414 |
| 3,425,309 A | | 2/1969 | Elizas et al. | 84/414 |
| 3,668,296 A | | 6/1972 | Criscuolo | 84/414 |
| 4,282,793 A | | 8/1981 | Muchnick | 84/414 |
| 4,308,782 A | | 1/1982 | Hartry | 84/414 |
| 4,362,081 A | * | 12/1982 | Hartry | 84/414 |
| 4,416,181 A | * | 11/1983 | Hartry et al. | 84/272 |
| 4,549,462 A | * | 10/1985 | Hartry et al. | 84/413 |
| 4,798,121 A | * | 1/1989 | Donohoe | 84/414 |
| 5,091,248 A | | 2/1992 | Belli | 428/290 |
| 5,581,044 A | * | 12/1996 | Belli et al. | 84/414 |

FOREIGN PATENT DOCUMENTS

CH 661 608 A5 7/1987

* cited by examiner

*Primary Examiner*—Robert E. Nappi
*Assistant Examiner*—Kim Lockett
(74) *Attorney, Agent, or Firm*—St. Onge Steward Johnston & Reens LLC

(57) ABSTRACT

A drum head material is prepared by assembling a multi-layer laminate comprising upper and lower sheets of resilient, polymeric film and at least two oriented fiber layers positioned between said sheets. Each of the oriented fiber layers comprises parallel resilient fibers having high modulus of elasticity and a defined direction of orientation. The layers are positioned such that the directions of orientation of the two layers intersect. The layers are pressed to adhere them and form a drumhead membrane. In the preferred form, the films are of polyethylene terephthalate and the fibers are of polyaramid. If two fiber layers are employed, the fibers in the layers preferably intersect at right angles. If three layers of fibers are employed, the fibers preferably intersect at an angle of 60 degrees.

20 Claims, 2 Drawing Sheets

DRUMHEAD MATERIAL AND METHOD

BACKGROUND OF THE INVENTION

The invention relates to a new type of drumhead material which has improved properties over known materials.

A problem experienced by most all drumheads is excessive stretch and the resultant effect on tonal quality. Drumheads that stretch too much don't have the correct sound -often not as high as might be desired. The excessive stretch can also affect the ability to properly tension a drumhead material.

In addition to providing the proper tonal qualities, a drumhead should be resistant to failure due to delamination or abrasion failure due simply to the normal and natural use of the drum. Unfortunately, the desire to achieve proper tone by simply further tightening conventional drumheads can overly stress those materials. A review of the prior art indicates that the various inventors have noted that one improvement in defined properties often fails to address weaknesses in others.

Drumheads must be able to resist stresses of a number of different kinds. Again, this is in addition to achieving the proper tonal quality. A good drumhead provides good tome and resists the various stresses normally encountered. As will be familiar to drummers, there are a variety of drum strokes and striking implements. Among the implements are all wooden and plastic-tipped sticks, brushes and mallets. Each of these is used for characteristic strokes. For example, drumsticks might be used for single strokes, double strokes and rolls. Of these, the single strokes are often the sharpest in terms of impact force, but slowest in frequency. The roll, of course, is not particularly high in impact, but is high in frequency. The mallets have a high total force, which is usually spread out somewhat due to the nature of the mallet head. The brushes, on the other hand, produce little impact force but, being typically of metal, will be a source of abrasion. Thus, a drumhead, to be successfully used, must be able to absorb and resist a number of stressful and abrasive contacts. It must also be resistant to a number of environmentally-induced stresses, such as humidity and temperature changes. It would be advantageous to provide a drumhead material which had reliable resistance to each of these stresses and a good balance of resistance to all.

In an early attempt to make a drumhead of a synthetic material, Heybeck, in U.S. Pat. No. 729,936, stiffened woven fabric with a shellac-based material. Later, in U.S. Pat. No. 1,018,767, Logan used two or more layers of a fabric such as linen, treated with a cement formed of fish glue, rubber, turpentine, shellac, white of eggs, gum arabic, and linseed oil. In a later patent, U.S. Pat. No. 1,809,050, Logan states that the material of his earlier patent must be made too thick to reproduce higher or sharp tones. To achieve this effect, he describes a material having a layer of fabric and a layer of skin, united by glue.

More recently, in U.S. Pat. No. 2,667,098, McMullen attempted to solve the problems experienced with animal skins and substitutes for them and proposed a material comprised of a woven acrylonitrile fiber fabric coated with an alkyd resin before stretching and another layer of alkyd resin after stretching. He noted that peeling and cracking of the surface was prevented while the material was essentially insensitive to changes in humidity.

In another attempt to provide a synthetic drumhead material, Elzas, et al., in U.S. Pat. No. 3,425,309, utilized a sheet of polyester yarn woven fabric. The procedure they described, called for the fabric to be pretensioned and/or stabilized and/or heat sealed under pressure to enhance the dimensional stability of the fabric. The stabilized fabric was then subjected to a silica treatment, tensioned and sprayed with additional resin. In U.S. Pat. No. 3,668,296, Crisculo described a molded drumhead that could include an embedded layer of woven fabric material. These two patents were referenced in U.S. Pat. No. 4,282,793 to Muchnick which described a composite drumhead comprising polyaramid fiber fabric impregnated with a rigidifying amount of epoxy polymer. Muchnick also discussed the problems with polyester films, such as those made from Mylar brand film.

In two U.S. Pat. Nos. 4,308,782 and 4,362,081, Hartry attempted to finally solve the problems with known hide and synthetic drumheads. In each he utilized materials having good strength and resilience, but the disclosures utilize fabric forms and construction methods that are now found to fall short of their potential in achieving a satisfactory drumhead material.

In the first, U.S. Pat. No. 4,308,782, Hartry provided a sheet of synthetic plastic material and a synthetic fabric material having a random fiber orientation. He applied a water-based resin emulsion to the fabric to assure that the nonoriented individual fibers were elastomerically bonded together. The version illustrated in the patent had a top surface of fabric over a bottom surface of a polyester film. He indicated that the fibers were elastomerically bonded together rather than rigidly bonded so as not to transfer stress into the plastic sheet material and to aid the "cushion" effect by distributing load. Thus, although he had proposed high strength materials for the fabric layer, the layer inherently avoids the benefit of the strength by permitting the elastomeric binder rather than the fibers of the fabric to take on the initial load applied during use.

In the latter patent, U.S. Pat. No. 4,362,018, Hartry described a drumhead material which employed top and bottom sheets of polyester film and an intermediate layer of woven fabric of high modulus of elasticity, such as a polyaramid sold under the Kevlar brand name. The mobility of the individual fibers throughout the synthetic woven fabric layer was maintained. The synthetic woven fabric material was not wetted through, or impregnated, by the adhesive resin composition employed in the lamination process to allow the individual fibers in the woven fabric to move freely. Therefore, the adhesive resin composition preferably was chosen to have a high molecular weight, high viscosity, and correspondingly low mobility to minimize its penetration of the fabric layer during the lamination process. Thus, in each of Hartry's arrangements, the movement of the fibers was assured prior to their being tensioned in use to fully utilize their high modulus properties.

In a distinct approach from that of Hartry, Donohoe indicated in U.S. Pat. No. 4,798,121, that in both of the above-identified Hartry patents the entire drumhead is laminated with the specified materials. Donohoe indicates that this produces a sound quality substantially different from that achievable with an unlaminated polyester film. To improve this, Donohoe employed an overlay consisting of two sheets or lamina of woven synthetic plastic fibers, which were coated with a synthetic plastic material. The two sheets were cross-laminated together with their woof directions perpendicular to one another, and then fastened to the upper surface of a central region of a drumhead made of plastic film, thereby increasing the impact resistance on the drumhead. The plastic coating on the upper surface of the upper lamina was said to enhance impact resistance, and also result in a crisp impact sound when struck by a drumstick. It can be seen that only a small impact area is covered to preserve the sound of the unlaminated film.

In U.S. Pat. No. 5,091,248, to Balli, in discussing the Hartry patents, it was stated that the Hartry invention did not address a very critical problem in the technology relative to the delamination of the nonorientated polyethylene fibers in the fabric material. He described his improvement as lamination comprising an upper fabric layer made of nonorientated polyester fibers, a lower plastic layer, and a substance which, when applied to the fabric, creates a seal on the surface and impregnates the material acting to further create a bond among the fibers. This combination of elements, he indicated, would preclude delamination of the polyester fibers, particularly when the fabric surface was exposed to the constant pounding of drumsticks or the continuous circular or sweeping motion of a drum brush. It will be noted, however, that the proposed solution requires nonoriented fibers—fibers that are bent to straighten them before their full strength and high modulus are utilized.

What is needed, therefore, is a new type of material for making drumheads that will have good tonal qualities yet resist failure due to impact stress, delamination and abrasion.

SUMMARY OF THE INVENTION

Accordingly, it is an object of the present invention to provide a new type of material for making drumheads.

Still another object of the invention is to provide a method for making a drumhead membrane material exhibiting minimal stretch under applied stress.

It is still another object of the invention to provide a drumhead membrane material having good tonal quality and physical properties.

It is still another object of the invention to provide a drumhead membrane material having good abrasion resistance along with minimal stretch and good tonal quality.

It is still another object of the invention to provide a drumhead membrane material having good resistance to delamination along with minimal stretch and good tonal quality.

It is still another object of the invention to provide a drumhead membrane material having good resistance to impact failure along with minimal stretch and good tonal quality.

It is still another object of the invention to provide a drumhead membrane material having good resistance to changes in environmental conditions along with minimal stretch and good tonal quality.

Another object of the invention is to provide methods of making and using the above-noted drumhead materials.

It is yet another object of the invention is to provide the products of the various processes described, all having improved properties important to drum heads.

These and other objectives are achieved by the invention, which provides a new drumhead membrane material and a process for preparing it.

In one preferred embodiment of the invention, the process for the drumhead membrane, comprises: assembling a multilayer laminate comprising upper and lower sheets of resilient, polymeric film and at least two oriented fiber layers positioned between said sheets, wherein each of the oriented fiber layers comprises parallel resilient fibers having high modulus of elasticity and a defined direction of orientation, and the layers are positioned such that the directions of orientation of the two layers intersect; and pressing said laminate to adhere all layers and thereby form a drumhead membrane exhibiting minimal stretch and good tonal quality.

The preferred membrane of the invention will comprise: upper and lower sheets of resilient polymeric film characterized by uniform and predictable stretch resistance, preferably within a few percent variation regardless of direction of applied stress. The preferred resilient polymeric films will have thicknesses of from about 25 to about 250 $\mu$m.; and at least two oriented fiber layers positioned between said sheets, said oriented fiber layers comprised of a resilient polymer and characterized by a high initial modulus and no creep. Typical of the preferred fibers are those having weights of from about 100 to about 3000 denier. In the preferred membrane structures, each of said oriented fiber layers comprises fibers oriented in a single direction and the layers are positioned such that the directions of orientation of the fibers intersect.

The membrane will preferably comprise at least two and up to three or four layers of oriented fibers, the direction of orientation of the fibers of the layers intersecting at an angle substantially defined by the calculation of 180 degrees divided by the number of fiber layers.

Other preferred aspects of the invention and their advantages are described below.

BRIEF DESCRIPTION OF THE DRAWINGS

The invention and its particular features will become more apparent from the following detailed description considered with reference to the accompanying drawings.

DETAILED DESCRIPTION OF THE INVENTION

The following description will detail preferred embodiments of the invention, to best show the preparation of a composite drum head material according to the invention using preferred materials and methods.

Figure 1:
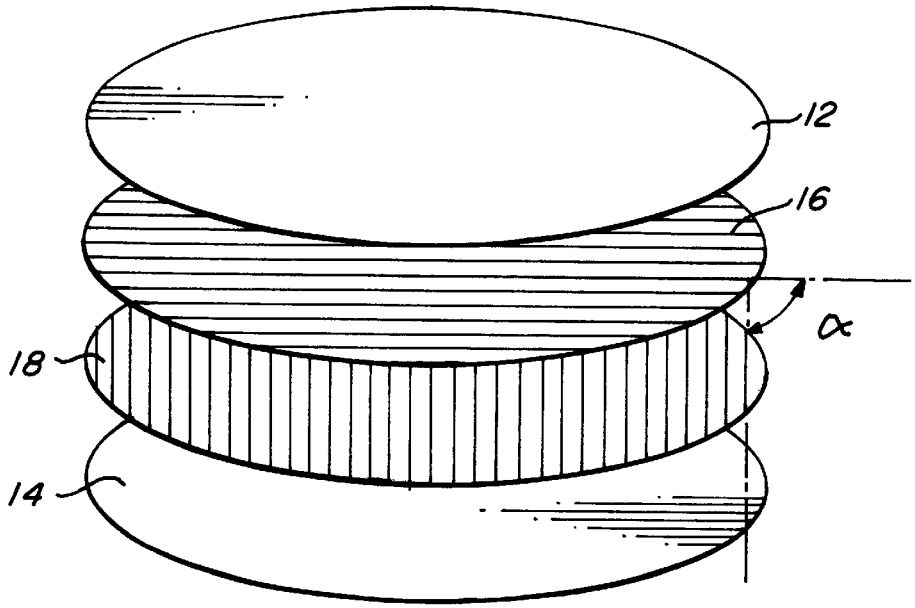
FIG. 1 is a perspective view, exploded to show the arrangement for assembly of a multi-layer laminate comprising upper and lower sheets of resilient, polymeric film and two oriented fiber layers positioned between the sheets of film.

FIG. 1 is a perspective view, exploded to show the arrangement for assembly of a multi-layer laminate comprising upper and lower sheets of resilient, polymeric film and at least two oriented fiber layers of high modulus of elasticity positioned between the sheets. By the term "initial modulus of elasticity" or simply "modulus", it is meant the force in kilograms necessary to result in an elongation of 1%, as measured by an Instron stress strain instrument, with the fiber stretched while being held between two jaws. Preferred fiber materials will have a modulus of from 100 to 1000 grams per denier, preferably from about 80 to 800 grams per denier.

FIG. 1 shows an upper layer of polymeric film and a lower layer of similar, preferably the same, film 14. Between the two layers of film are shown two layers of oriented fibers, namely upper layer 16 and lower layer 18. From 2 to about 5 layers of fibers can be employed, but the preferred number is 2 or 3. The intersection of the fibers in the layers is selected so that the stress on the fibers applied during use will be uniformly transmitted in all directions. For example, it is preferred that the fibers in the layers be oriented between each other such that angle a can be defined as the quotient of 180° divided by the number of oriented fiber layers. The angle a in the case of three layers would be 60°, with no two layers having parallel orientation. An advantage of the invention is that the fibers are not bent or crimped into woven or nonwoven fabric, but immediately apply their high strength to resisting the force of an applied stress. Another advantage is that the applied force is transmitted uniformly across the membrane due to the fiber orientation.

The fibers in the layers, e.g., 16 and 18, of the laminate are comprised of a high modulus of elasticity material. Preferably, this material will be one selected from the group consisting of polyaramid, polyacrylonitrile, ultrahigh molecular weight polyethylene, polyethylenenaphthanate, carbon and PBO (e.g., Xylon poly (t-phenylene-2,6-benzobisoxazole) and Vectran® fibers of liquid crystal polymer. Polyaramid fibers, such as produced by E. I. duPont de Nemours & Co., Inc., under the registered trademark KEVLAR®, have been found suitable. The diameter of the fibers will depend on the ultimate type of drum instrument to be made, but will typically fall within the range of from about 100 to about 3000 denier, preferably from about 375 to about 1500 denier and more narrowly from 800 to 1400 denier. It is preferred that an individual layer of fibers will be only a single thickness of the fibers, but in some cases a multiple fiber thickness can be employed.

The polymeric film is comprised of a material selected from the group consisting of polyethylene teraphthalate, polyaramid, polyacrylonitrile, ultrahigh molecular weight polyethylene, polyethylenenaphthanate. Preferably, the film will comprise a material characterized by biaxial orientation and a tensile strength of at least 20 kg/mm$^2$ in both the machine and transverse directions. Typical of preferred films will be those with modulus values of at least 400 kg/mm$^2$, e.g., about 500 kg/mm$^2$. For a number of reasons the material of choice for the film is polyethylene teraphthalate, such as is available from E. I. duPont de Nemours & Co., Inc., under the registered trademark MYLAR® and from Toray as LUMIRROR®. Acceptable film thicknesses will depend on the type of drum intended, but will typically fall within the range of from about 1 to about 100$\mu$, preferably the sheets of resilient polymeric film having a thickness of from 10 to 25$\mu$. In cases where the film is not uniformly oriented in machine and transverse directions, it will be important to match the orientation of the film with that of the fibers to assure uniform stress transfer across the membrane.

Figure 2:
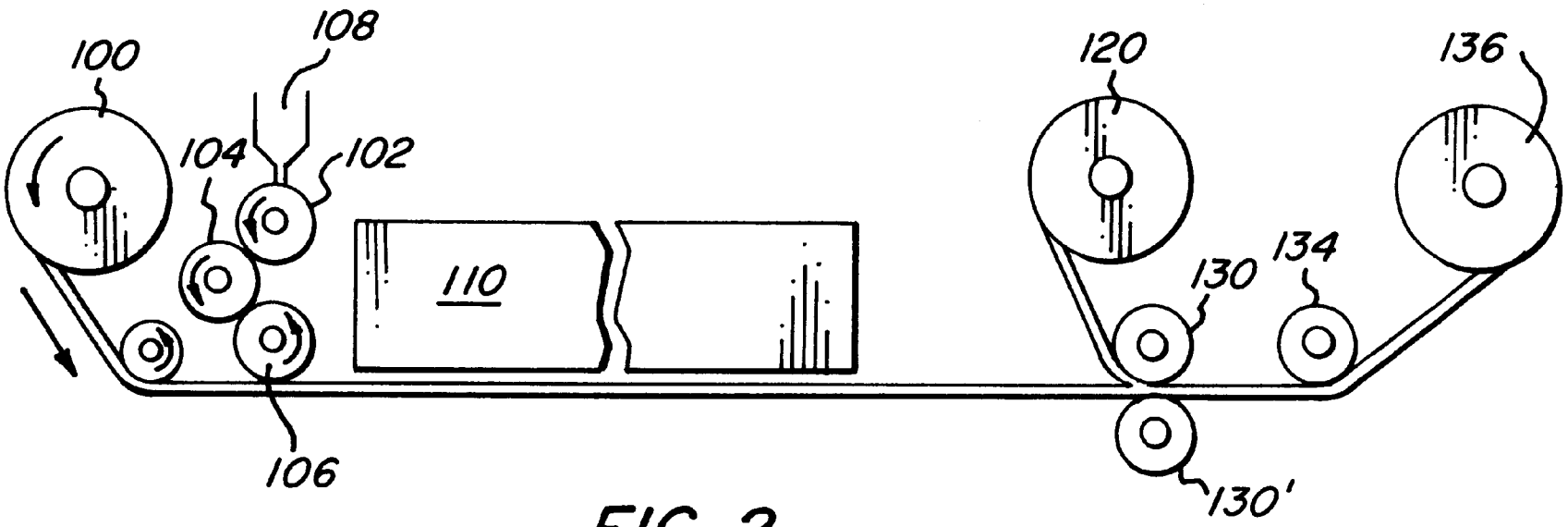
FIG. 2 is a schematic view of one process arrangement according to the invention.

FIG. 2 is a schematic view of one process arrangement according to the invention. Film is unrolled from drum 100 and fed in the direction of the arrow prior to coating with a suitable adhesive by coating rollers 102, 104, and 106, the adhesive being supplied by hopper or other suitable feed device 108. A suitable adhesive is a solvent-based polyurethane, two part adhesive such as Adcote® 123 available from Morton International of Woodstock, Ill. Adhesives of this type are characterized by the ability to be coated uniformly, wetting both the polymer film and the fibers during application and curing to form a high-molecular weight polymer which forms a strong bond with the film and the fibers. Other suitable materials of this type are polyurethanes and polyester/polyurethanes. When a solvent-based adhesive of this type is employed, the film will be fed through a suitable oven 110 (shown foreshortened) after application to remove the solvent and dry the adhesive to the touch. A typical application rate will be about 30 to about 40 grams per square meter. Oven conditions will be selected as guided by the manufacturer, e.g., from about 2 to about 4 minutes at about 90 to about 120° C. passage through the oven 110, preferably a sheet of unidirectional fibers is fed from spool 120 (can use a creel). The film and fibers are pressed together by nip rollers 130 and 130' or other suitable mechanism. The laminate is collected by guide roll 134 onto take-up roller 136.

Figure 3:
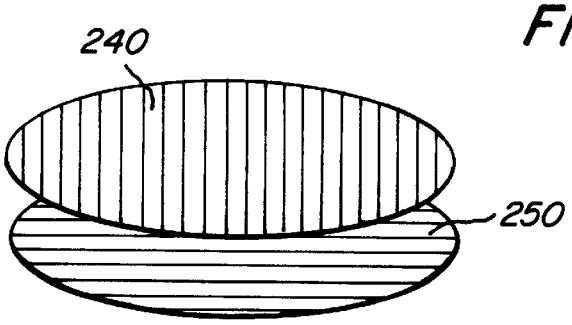
FIG. 3 is a perspective view, again exploded to show one alternative assembly sequence according to the invention.

Once a laminate of this type is prepared, it can be used as a base or stock material to prepare the drumhead material of the invention. For example, as shown in FIG. 3, two sheets 210 and 211 of a stock material as so prepared are oriented for assembly. Prior to assembly, adhesive is applied between adjoining layers to assure bonding of the multi-layer laminate, preferably applying the adhesive to both surfaces to be bonded. The adhesive will preferably be of the type and applied at the rates noted above. Thus, according to this procedure, the process would entail forming an intermediate laminate composite by applying adhesive between a sheet of resilient polymeric film and a layer of oriented elastic fibers as in FIG. 2. Then, the adhesive will be partially set to form the intermediate laminate having a direction of orientation defined by the orientation of the fibers. This intermediate laminate will then be cut to form at least two face sheets, namely 240 ands 250 as shown in FIG. 3, having a film face and a fiber face. The film face would, in the example of FIG. 3 be the top of 240 and the fiber face would be at the bottom. In other words, the film face would have the film on the outside and the fiber face would have the fibers exposed. The two face sheets 240 and 250 are then assembled such that the film faces is exposed, the fiber faces are internal and the directions of orientation of the two face sheets intersect.

Figure 4:
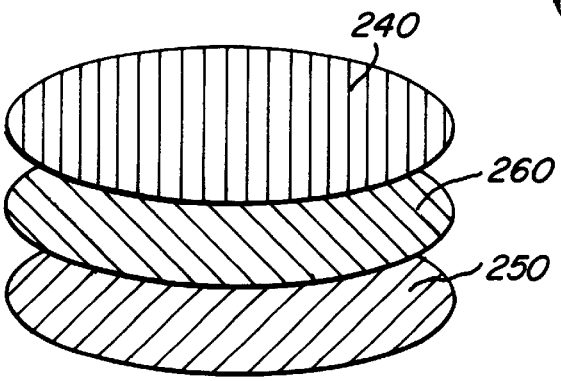
FIG. 4 is a view similar to FIG. 3, but showing another assembly arrangement according to the invention.

In the embodiment of FIG. 4, at least one additional oriented fiber layer 260 is placed between said two face sheets such that the fibers in all layers intersect each other, preferably the intersection is at an angle defined by the quotient of 180° divided by the number of oriented fiber layers. Preferably, in the assembly, adhesive is applied to each surface of each layer within the multi-layer laminate, that contact another layer therein.

Figure 5:
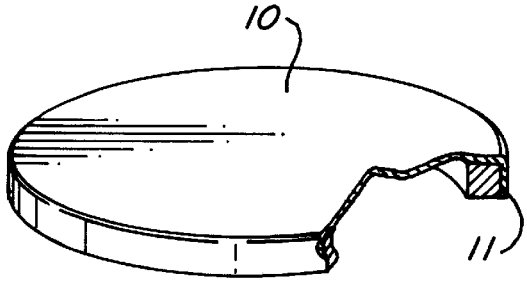
FIG. 5 is a perspective view of a drumhead according to the invention.

FIG. 5 illustrates a drumhead according to the invention comprising: a drumhead membrane 10 as defined above; and attachment ring means 11 of typical construction for tensioning said membrane and attaching it to a drum body. The guiding principal here is to avoid small radius bending that could cause the material to fail. Total membrane thicknesses can vary from about 250 to about 600$\mu$, with the thinner membranes being utilized on smaller drums and the thicker membranes, generally on larger drums.

The following examples are for the purpose of further illustrating and explaining the invention and are not to be taken as limiting in any regard. Unless otherwise indicated, all parts and percentages are by weight.

EXAMPLE 1

This example describes the preparation of a particular drum head material according to the invention, in particular as illustrated in FIG. 4, utilizing an apparatus as schematically shown in essential features in FIG. 2. A 125$\mu$ biaxially-oriented, white polyethylene terephthalate film is coated with the noted Adcote® adhesive at a rate of about 1 ounce/yard$^2$ and a sheet of 1140 Kevlar® fibers oriented in the machine direction is laid thereon are nipped under tension and dried. Similarly, a 75$\mu$ clear biaxially-oriented, polyethylene terephthalate film is coated with the noted Adcote® adhesive at a rate of about 1 ounce/yard$^2$ and a sheet of 1140 Kevlar® fibers oriented in the machine direction is laid thereon are nipped under tension and dried. Both laminates prepared in this manner are allowed to cure for a week. Then, both are again coated with adhesive on the fiber side and passed through the dryer. The laminate having the clear film is then cut into squares of suitable size for cutting a drumhead blank, oriented 90° to the machine direction, and spliced with tape to form a long web. The laminate with the white outer film layer (which will be the top) is then again coated with the adhesive and nipped together with the spliced laminate and dried and cured. Round drumhead blanks are then stamped out.

The above description is for the purpose of teaching the person of ordinary skill in the art how to practice the present invention, and it is not intended to detail all of those obvious modifications and variations of it which will become apparent to the skilled worker upon reading this description. It is intended, however, that all such obvious modifications and variations be included within the scope of the present invention which is defined by the following claims. The claims cover the indicated components and steps in all arrangements and sequences which are effective to meet the objectives intended for the invention, unless the context specifically indicates the contrary.

What is claimed is:

1. A method of preparing a drumhead membrane, comprising:

laminate comprising upper and lower sheets of resilient, polymeric film and at least two oriented fiber layers positioned between said sheets, wherein each of the oriented fiber layers comprises parallel resilient fibers having high modulus of elasticity and a defined direction of orientation, and the layers are positioned such that the directions of orientation of the two layers intersect; and pressing said laminate to adhere all layers and thereby form a drumhead membrane.

2. A method according to claim 1 wherein the sheets of resilient polymer film are characterized by an initial modulus of elasticity of at least 400 kg/mm$^2$.

3. A method according to claim 1 wherein the elastic fibers are characterized by an initial modulus of elasticity of 100 to 1000 grams per denier.

4. A method according to claim 1 wherein adhesive is applied between adjoining layers of the multi-layer laminate prior to assembly.

5. A method according to claim 1 wherein the step of assembling the multi-layer laminate comprises:

forming an intermediate laminate composite by applying adhesive between a sheet of resilient polymeric film and a layer of oriented elastic fibers;

partially setting the adhesive to form the intermediate laminate having a direction of orientation defined by the orientation of the fibers;

cutting the intermediate laminate to form at least two face sheets having a film face and a fiber face; and assembling two face sheets such that the film faces is exposed, the fiber faces are internal and the directions of orientation of the two face sheets intersect.

6. A method according to claim 5 wherein, prior to assembling said two face sheets, adhesive is applied to the fiber face of each.

7. A method according to claim 5, wherein at least one additional oriented fiber layer is placed between said two face sheets such that the fibers in all layers intersect each other.

8. A method according to claim 1 wherein the intersection is an angle defined by the quotient of 180° divided by the number of oriented fiber layers.

9. A method according to claim 1 wherein adhesive is applied to each surface of each layer within the multi-layer laminate, that contact another layer therein.

10. A method according to claim 1 wherein the polymeric film is comprised of a material selected from the group consisting of polyethylene teraphthalate, polyaramid, polyacrylonitrile, ultrahigh molecular weight polyethylene, polyethylenenaphthanate.

11. A method according to claim 10 wherein the sheets of resilient polymeric film are comprised of polyethylene terephthalate and has a thickness of from 10 to 25$\mu$.

12. A method according to claim 1 wherein the fibers are comprised of a material selected from the group consisting of polyaramid, polyacrylonitrile, ultrahigh molecular weight polyethylene, polyethylenenaphthanate, carbon PBO and liquid crystal polymer.

13. A method according to claim 12 wherein the fibers are comprised of polyaramid and have a weight of from 375 to 1500 denier.

14. A method according to claim 1 wherein the adhesive is selected from the group consisting of polyester, polyurethane, and combinations thereof.

15. A drumhead membrane having good tonal qualities, good abrasion resistance and high resistance to delamination, formed of a multi-layer laminate, comprising:

upper and lower sheets of resilient polymeric film characterized by high initial modulus and having a thickness of 25 to 250 $\mu$m.; and at least two oriented fiber layers positioned between said sheets, said oriented fiber layers comprised of a resilient polymer and characterized by high initial modulus and having a weight of from 100 to 3000 denier;

wherein each of said oriented fiber layers comprises fibers oriented in a single direction and the layers are positions such that the directions of orientation of the fibers intersect.

16. A drumhead membrane according to claim 15 wherein the intersection is at an angle defined by the quotient of 180° divided by the number of oriented fiber layers.

17. A drumhead membrane according to claim 16 which further comprises at least one additional layer of oriented fibers positioned between said sheets of resilient polymeric films such that the fibers in all layers interest each other as in claim 16.

18. A drumhead membrane according to claim 15 wherein the fibers are comprised of polyaramid and the sheets are comprised of polyester.

19. A drumhead membrane material according to claim 16.

20. A drumhead comprising:

a drumhead membrane as defined in claim 16; and means for tensioning said membrane and attaching it to a drum body.

* * * * *